United States Patent [19]

Barisoni et al.

[11] 3,959,033

[45] May 25, 1976

[54] PROCESS FOR MANUFACTURING SILICON-ALUMINUM STEEL SHEET WITH ORIENTED GRAINS FOR MAGNETIC APPLICATIONS, AND PRODUCTS THUS OBTAINED

[76] Inventors: Mario Barisoni, Via Pomeo Magno n. 26, Albano Laziale (Rome); Massimo Barteri, Piazza Vinci n. 60, Rome; Pietro Brozzo, Via Pompeo Magno, Albano Laziale (Rome); Edmondo Marianeschi, Via Aulo Pompeo N. 6, Terni; Roberto Ricci Bitti, Via Kennedy n. 32, Lanuvio (Rome), all of Italy

[22] Filed: July 23, 1974

[21] Appl. No.: 491,152

[30] Foreign Application Priority Data

July 23, 1973 Italy ..... 51587/73
Sept. 19, 1973 Italy ..... 52607/73

[52] U.S. Cl. ..... 148/112; 148/31.55; 148/111

[51] Int. Cl.[2] ..... H01F 1/04

[58] Field of Search ..... 148/111, 112, 113, 31.55, 148/120, 121; 75/123 L

[56] References Cited

UNITED STATES PATENTS

| | | | |
|---|---|---|---|
| 1,752,490 | 4/1930 | Karcher | 148/112 |
| 3,151,005 | 9/1964 | Alworth et al. | 148/111 |
| 3,287,183 | 11/1966 | Taguchi et al. | 148/111 |
| 3,632,456 | 1/1972 | Sakakura et al. | 148/111 |
| 3,636,579 | 1/1972 | Sakakura et al. | 148/111 |
| 3,671,337 | 6/1972 | Kumai et al. | 148/111 |
| 3,846,187 | 11/1974 | Sakakura et al. | 148/112 |

*Primary Examiner*—Walter R. Satterfield
*Attorney, Agent, or Firm*—Young & Thompson

[57] ABSTRACT

Low carbon silicon-aluminum single-oriented steel sheet having high magnetic induction is produced by hot rolling at 1370°–1430°C., annealing from 10 to 60 seconds at 1050 to 1170°C., slow cooling to 700°–900°C., quenching from 700°–900°C., cold rolling with a reduction in thickness of 80 to 90%, recrystallization and decarburization annealing in wet hydrogen from 780° to 870°C. for 2 minutes, and final annealing at 1200°C. in a mixture of 10–50% hydrogen and 50–90% nitrogen. Cold rolling can be effected in two stages, the first stage to reduce the thickness by 20 to 50% followed by annealing at 700° to 900°C., quenching and final cold rolling with a reduction in thickness of 80 to 90%. The preferred temperature range prior to quenching, for one-step cold rolling, is 750° to 850°C.; and for two-step cold rolling, the first quench is preferably from a temperature of 750° to 850° C. and the second quench preferably from a temperature of 850° to 900°C.

6 Claims, No Drawings

PROCESS FOR MANUFACTURING SILICON-ALUMINUM STEEL SHEET WITH ORIENTED GRAINS FOR MAGNETIC APPLICATIONS, AND PRODUCTS THUS OBTAINED

The present invention relates to a process for manufacturing steel sheet with oriented grains for magnetic applications, and products thus obtained.

More exactly, the present invention relates to single-oriented electrical sheet having high magnetic flux values and low magnetic reversal losses produced from a silicon steel material containing also aluminum.

It is known that an improvement of the magnetic properties is accompanied by a reduction of the watt loss, as well as by the possibility of reducing the intensity of the magnetic field necessary to produce the desired flux density.

It is also known that a remarkable improvement of the magnetic properties of the sheet is obtained by creating the chemico-physical conditions necessary for the formation, in the metallic matrix, of single-oriented grains, by means of the phenomen of secondary recrystallization, consisting in the preferential growth of (110) [001] oriented grains, when the steel is subjected to a treatment comprising the combination of one or more steps of cold rolling with intermediate annealing and then a final high-temperature annealing.

The occurrence of the phenomenon is dependent on the presence of impurities such as MnS, AlN and VN, able to form a dispersed phase of suitable dimensions within the steel matrix. These substances exert their influence during the final anneal of the steel, already rolled to its final thickness, by causing the selective growth of the grains with a crystalline orientation as defined by Miller's indices (110) [001].

It has now, surprisingly, been found that, by subjecting silicon steel sheets containing aluminum to the process according to the invention, it is possible to obtain electrical sheet with single-oriented grains and with a quality which is superior to that obtained by the known methods.

The process which is the object of the invention consists essentially in subjecting silicon steel containing aluminum to the following steps:

hot rolling after reheating;

annealing at high temperature in order to favor the solution of low-solubility phases;

quenching in order to favor the precipitation in dispersed form of the low-solubility phases;

cold rolling;

primary recrystallization and decarburization annealing;

final, high-temperature annealing under controlled atmosphere to favor the growth of oriented grains.

The cold rolling step can be varied by performing it in a single or in two stages. In both cases, the other steps remain unvaried. In both variants, each cold rolling step is preceded by an annealing and quenching of the material. Preferably the temperatures and times of treatment in the single, above listed steps for a steel containing 2.6 to 3.5% Si and from 0.01 to 0.05% Al are the following:

a. reheating of the slab at a temperature between 1370° and 1430°C., prior to the hot rolling step;

b. annealing at a temperature within the range of 1050° to 1170°C., preferably of 1120° to 1170°C., for a soaking time from 10 to 60 seconds, and slow cooling to 700°–900°C., preferably 750°–850°C., at a cooling rate that does not exceed 10°C. per second;

c. drastic quenching from 700°–900°C., preferably from 750°–850°C., at an average quenching rate of 15°–150°C. per second, preferably 50°–150°C. per second;

d. cold rolling with a reduction within the range of 80 to 90%;

e. recrystallization and decarburization annealing at 780°–870°C. for two minutes;

f. heating up to 1200°C. and annealing, both carried out in an atmosphere consisting essentially of 10–50% by volume of hydrogen and 50–90% by volume of nitrogen.

It has now been found that the surprising increase in the magnetic properties of single-oriented silicon steel sheets treated according to the process explained above is due to the formation within the steel, as a result of the treatment, of at least one phase other than aluminum nitride, (which is however present), which enhances the effect of this aluminum nitride.

A confirmation of this fact is provided by the following experiment: a sample of silicon steel, after hot rolling, was annealed at 1150°C. and then quenched in air from 800°C. This sample was divided into two parts one of which, after cold rolling with 85% reduction and final decarburization and annealing, showed an average value of magnetic induction $B_{10}$ of 17,200 gauss. The other half of the sample was annealed at 900°C. for 6 minutes—and at this temperature there is no change either in the quantity or in the distribution of the previously precipitated aluminum nitride—and then quenched in water from 900°C. After cold rolling, decarburization and annealing identical to that undergone by the first part of the sample, this second part showed a mean value of magnetic induction equal to 19,300 gauss. It is thus clear that the improvement of the magnetic induction properties is not due to the presence of AlN alone, but also to some other phenomenon which takes place during the second treatment of quenching from 900°C. A thorough study of the steels treated according to the present invention has shown that the phenomenon responsible for the increase in the magnetic induction properties is the formation of a high-hardness phase dispersed in the ferritic matrix. The presence of this phase may be easily determined by examination with the metallographic microscope, by measurements of its microhardness and of the macrohardness which it imparts to the steel.

The object of the present invention is thus to provide a silicon steel, which, when suitably treated, shows a certain quantity of a high-hardness phase, and to provide a process by which such product is obtained.

The process variant with cold rolling in two stages, comprises:

cold rolling to an intermediate gauge with a reduction in thickness within the range of 20 to 50%, preferably of about 30%;

intermediate annealing at a temperature within the range of 700° to 900°C., preferably at 850°–900°C., for a soaking time within the range of 1 to 10 minutes;

drastic quenching from a temperature within the range of 700° to 900°C., preferably 850° to 900°C., at an average quenching rate of 15°–150°C. per second, preferably 50°–150°C. per second;

final cold rolling step with a reduction within the range of 80 to 90%.

Surprisingly, it has been found that only by strictly complying with the process sequences, temperatures and time ranges described in the two above variations an optimum formation (quantity- and dispersion-wise) of a high-hardness phase is obtained, such as to reach very high values of magnetic induction.

For the sake of comparison, a well known treatment process of treating silicon steel, which will be described in the following, yields the following magnetic properties: mean value of the magnetic induction $B_{10}=18{,}500$ gauss with a dispersion of ±600 gauss. This known treatment is the following:

A steel having the following percent composition by weight: C 0.05; Si 2.8; Mn 0.1; Al 0.05; $N_2$ 0.008, balance Fe, is cast and then subjected to the following process:

hot rolling to a strip 3.1 mm thick;
annealing at 1160°C. for 40 seconds;
slow cooling in ambient air to 950°C.;
quenching in water from 950°C.;
cold rolling to an intermediate gauge with a reduction in thickness of 30%;
annealing at 950°C. for three minutes;
drastic quenching in water from 950°C.;
final cold rolling, with a reduction in thickness of 85%;
annealing at 800°C. for two minutes in a reducing atmosphere containing wet $H_2$;
final annealing for 36 hours in an atmosphere containing 80% $N_2$ and 20% $H_2$ at a temperature of 1200°C.

For a purely illustrative and in no way limitative purpose some examples of carrying the invention into practice will now be described.

EXAMPLE 1

A steel having the following percent composition by weight: C 0.05; Si 2.7; Mn 0.1; Al 0.05; $N_2$ 0.008; V, Ti 0.005 max; balance Fe, is continuously cast and then subjected to the process according to the invention consisting in:

hot rolling to a strip 2.3 mm thick;
annealing at 1160°C. for 30 seconds;
slow cooling in ambient air to 800°C.;
quenching in water from 800°C. so as to arrive at ambient temperature in 10 seconds;
cold rolling with a reduction in thickness of 87%;
annealing and decarburizing in $H_2$ at 800°C. for 2 minutes;
final annealing for 36 hours in an atmosphere containing 80% by volume $N_2$ and 20% $H_2$ with a heating rate of 33°C/h to a final temperature of 1200°C.

The sheet thus obtained shows a value of the magnetic induction $B_{10}$ equal to 19,200 gauss (with a dispersion of ±300 gauss).

EXAMPLE 2

A steel having the following percent composition by weight: C 0.05; Si 2.6; Mn 0.1; Al 0.05; $N_2$ 0.008; balance Fe, is cast and subjected to the following process:

hot rolling to a strip 3.1 mm thick;
annealing at 1150°C. for 15 seconds;
slow cooling in ambient air to 800°C.;
drastic quench in water from 800°C.;
cold rolling to an intermediate guage with a reduction in thickness of 30%;
annealing at 850°C. for six minutes;

drastic quench in water from 850°C.;
final cold rolling step with a reduction in thickness of 87%;
annealing at 800°C. in a reducing atmosphere containing wet $H_2$ for two minutes;
final annealing for 36 hours in an atmosphere containing 80% by volume $N_2$ and 20% $H_2$ with a heating rate of 33°C/h to a final temperature of 1200°C.

The sheet thus obtained shows a value of $B_{10}$ of 19,530 gauss, with a dispersion of ±300 gauss.

EXAMPLE 3

A steel of the same composition as that in Example 2 is continuously cast and then subjected to the following process:

hot rolling to a strip 3.15 mm thick;
annealing at 1150°C. for 30 seconds;
slow cooling in ambient air to 850°C.;
quenching in water from 850°C. to ambient temperature in 10 seconds;
cold rolling to an intermediate guage with a reduction in thickness of 30%;
annealing at 900°C. for six minutes;
drastic quench in water from 900°C.;
final cold rolling step with a reduction in thickness of 87%;
annealing and decarburizing in $H_2$ at 800°C. for 2 minutes;
final annealing at 1200°C. for 36 hours in an atmosphere containing 80% by volume $N_2$ and 20% $H_2$ with a heating rate of 33°C/h.

The sheet thus obtained shows a value of the magnetic induction $B_{10}$ equal to 19,300 gauss.

EXAMPLE 4

A steel having the following percent composition by weight: C 0.04; Si 2.9; Mn 0.08; Al 0.04; $N_2$ 0.0075; balance Fe, is cast and subjected to the following process:

hot rolling to a strip 3.1 mm thick;
annealing at 1140°C. for 10 seconds;
slow cooling in ambient air to 850°C.;
drastic quench in water from 850°C.;
cold rolling with a reduction in thickness of 87%;
annealing and decarburizing in wet $H_2$ at 800°C. for 2 minutes;
final annealing at 1200°C. for 36 hours in an atmosphere containing 80% by volume $N_2$ and 20% $H_2$ with a heating rate of 33°C.

The sheet thus obtained shows a value of $B_{10}$ equal to 19,270 gauss, with a dispersion of ±300 gauss.

The process of the present invention causes the formation, in the sheet, of a high-hardness phase having a microhardness of at least 600 HV and equalling at least 5–30% by volume of the sheet. Consequently, the macrohardness of the sheet averages at least 230 HV, while the macrohardness of comparable steel sheets obtained by known treatments averages approximately 200 HV, because no high hardness phase is induced in them.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a process for making single-oriented silicon steel sheet material having high magnetic induction, comprising the steps of hot rolling silicon steel containing 2.5–3.5% Si, 0.01–0.05% Al., up to 0.06% C, balance essentially iron, annealing the hot rolled steel at 1050° to 1170°C., slow cooling the annealed steel to a predetermined temperature at a cooling rate that does not exceed 10°C. per second, quenching the steel from said predetermined temperature at a rate of 15° to 150°C. per second, cold rolling the steel in the as-quenched condition with a reduction in thickness of 80 to 90%, recrystallizing and decarburizing the steel by annealing the steel in a reducing atmosphere, and finally annealing the steel in an atmosphere consisting essentially of a mixture of nitrogen and hydrogen; the improvement in which said predetermined temperature is 700° to 900°C., the resulting steel having a high hardness phase, including at least one phase other than aluminum nitride, together with aluminum nitride, said high hardness phase having a microhardness of at least 600 HV, said high hardness phase being present in the quantity from 5 to 30% by volume, and the sheet having an average macrohardness of at least 230 HV.

2. The process as claimed in claim 1, in which said predetermined temperature is 750° to 850°C.

3. In a process for making single-oriented silicon steel sheet material having high magnetic induction, comprising the steps of hot rolling silicon steel containing 2.5–3.5% Si, 0.01–0.05% Al, up to 0.06% C, balance essentially iron, annealing the hot rolled steel at 1050° to 1170°C., slow cooling the annealed steel to a predetermined temperature at a cooling rate that does not exceed 10°C. per second, quenching the steel from said predetermined temperature at a rate of 15° to 150°C. per second, cold rolling the steel in the as-quenched condition with a reduction in thickness of 20 to 50%, annealing the steel at a further predetermined temperature, further cold rolling the steel with a reduction in thickness of 80 to 90%, recrystallizing and decarburizing the steel by annealing the steel in a reducing atmosphere, and finally annealing the steel in an atmosphere consisting essentially of a mixture of nitrogen and hydrogen; the improvement in which both said predetermined temperature and said further predetermined temperature are 700° to 900°C., and in which the steel is quenched from said further predetermined temperature prior to said further cold rolling at a rate of 15° to 150°C. per second and said further cold rolling is performed in the as-quenched condition, the resulting steel having a high hardness phase, including at least one phase other than aluminum nitride, together with aluminum nitride, said high hardness phase having a microhardness of at least 600 HV, said high hardness phase being present in the quantity from 5 to 30% by volume, and the sheet having an average macrohardness of at least 230 HV.

4. A process as claimed in claim 3, in which said predetermined temperature is 750° to 850°C. and said further predetermined temperature is 850° to 900°C.

5. Single-oriented silicon steel sheet material produced by the process of claim 1.

6. Single-oriented silicon steel sheet material produced by the process of claim 3.

* * * * *